US007681251B2

(12) United States Patent
Carey

(10) Patent No.: US 7,681,251 B2
(45) **Date of Patent: *Mar. 23, 2010**

(54) HAT WITH SCARF

(75) Inventor: Michael J. Carey, San Diego, CA (US)

(73) Assignee: Seirus Innovative Accessories, Inc., Poway, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/684,402

(22) Filed: Mar. 9, 2007

(65) Prior Publication Data

US 2007/0204384 A1 Sep. 6, 2007

Related U.S. Application Data

(63) Continuation of application No. 10/314,522, filed on Dec. 6, 2002, now Pat. No. 7,188,374.

(60) Provisional application No. 60/338,184, filed on Dec. 7, 2001.

(51) Int. Cl.
*A42B 1/00* (2006.01)

(52) U.S. Cl. ..... 2/171; 2/209.13; 2/175.6; 2/184.5; 2/207

(58) Field of Classification Search ..... 2/207, 2/209.13, 175.6, 184.5
See application file for complete search history.

(56) References Cited

U.S. PATENT DOCUMENTS 202,262 A 4/1878 Isidor
557,625 A 4/1896 Tolle
731,135 A 6/1903 Scott
772,148 A 10/1904 Hughes
787,945 A 4/1905 Rautenberg
805,052 A 11/1905 Brooks
837,143 A 11/1906 Starr
1,023,677 A 4/1912 Pass
1,057,203 A 3/1913 Yudelson
1,156,980 A 10/1915 Coppers
1,309,783 A 7/1919 Slawin (Continued)

FOREIGN PATENT DOCUMENTS

FR 366884 10/2006

*Primary Examiner*—Gary L Welch
*Assistant Examiner*—Alissa J Tompkins
(74) *Attorney, Agent, or Firm*—Holme Roberts & Owen LLP

(57) ABSTRACT

A hat member has a lower rim with a scarf attached thereto which extends between the temple areas around the back of the head. The scarf has an eye edge proximate the lower part of the eye sockets and extends from there to an area proximate the juncture of the neck with the torso or trunk. The scarf is loose and has folds under the chin so that a coat or other outer garment can be positioned and closed there over without restricting movement of the user. The scarf extends from the rim down proximate the nape of the neck to protect the back of the head and the rear of the neck. The hat member has a crown into which the scarf member can be positioned and stored while the hat is being worn. In turn the scarf may be moved between a stored position in the crown of the hat member and a deployed position removed from the crown and deployed over and about the head of the user.

19 Claims, 12 Drawing Sheets

U.S. PATENT DOCUMENTS

| | | | | | |
|---|---|---|---|---|---|
| 1,525,030 | A | | 2/1925 | Galanis | |
| 2,276,612 | A | | 3/1942 | Ellis | |
| 2,353,025 | A | | 7/1944 | Gautreaux | |
| 2,446,530 | A | | 8/1948 | de Grazia et al. | |
| 2,897,510 | A | * | 8/1959 | Forbes-Robinson | 2/172 |
| 3,271,781 | A | | 9/1966 | Sontag et al. | |
| 3,668,705 | A | | 6/1972 | Garbisch | |
| 3,740,767 | A | | 6/1973 | Schuessler | |
| 3,768,100 | A | | 10/1973 | Coleman et al. | |
| 3,823,418 | A | | 7/1974 | Piper | |
| 3,838,467 | A | | 10/1974 | Zientara | |
| 3,943,575 | A | | 3/1976 | Bolker | |
| 4,180,868 | A | | 1/1980 | Snow | |
| 4,259,748 | A | | 4/1981 | Miller | |
| 4,300,240 | A | * | 11/1981 | Edwards | 2/206 |
| 4,641,380 | A | | 2/1987 | Epstein | |
| 4,941,211 | A | | 7/1990 | Blutstein | |
| 5,062,163 | A | | 11/1991 | Avey | |
| 5,109,548 | A | | 5/1992 | Balaban | |
| 5,214,804 | A | | 6/1993 | Carey et al. | |
| D339,676 | S | | 9/1993 | Geving | |
| D369,442 | S | | 4/1996 | Jones | |
| 5,713,076 | A | | 2/1998 | Davis | |
| 6,021,525 | A | * | 2/2000 | Mertins | 2/172 |
| 6,119,273 | A | | 9/2000 | Cho | |
| 6,272,690 | B1 | | 8/2001 | Carey et al. | |
| 6,481,021 | B2 | * | 11/2002 | Spell | 2/209.13 |
| 6,857,134 | B1 | * | 2/2005 | Cowell | 2/209.13 |

* cited by examiner

HAT WITH SCARF

CROSS-REFERENCE TO RELATED APPLICATIONS

This application is a continuation of U.S. application Ser. No. 10/314,522, filed Dec. 6, 2002 that issued as U.S. Pat. No. 7,188,374 on Mar. 13, 2007, which claims priority to Provisional Application No. 60/338,184, filed Dec. 7, 2001, both of which are incorporated herein by reference in their entireties.

BACKGROUND OF THE INVENTION

1. The Field of the Invention

This invention relates to outdoor clothing and more particularly to an article of clothing for wearing on the head or headware suitable for use in cold weather.

2. The Relevant Technology

In cold weather, a hat is often desired as an article of clothing for placement on the head (i.e., headware) for the long recognized purpose of keeping the head warm. A hat may also serve other recognized purposes including protection from sun, rain, snow, sleet, wind and the like.

In cold weather, a scarf may be desired for placement about the neck as an item of apparel to insulate from the cold and, of course, to also protect the neck area of a user from rain, snow, sleet, wind, and the like. In certain weather conditions, protection for the face from similar conditions may also be desired for such reasons.

U.S. Pat. No. 5,214,804 (Carey, et al.) discloses a protective mask with scarf suitable for use in cold weather. A mask disclosed is made with a fleece interior layer laminated to a closed cell neoprene exterior layer. A scarf member has a section of material that extends down into the neck area. The protective mask with scarf is marketed under the name COMBO SCARF. An improved version with a scarf, head piece and face mask has been sold prior hereto under names or marks such as COMBO CLAVA® and ULTRA CLAVA®. All have been sold by SEIRUS INNOVATIVE ACCESSORIES, INC. of 13975 Danielson Street, Poway, Calif.

SEIRUS INNOVATIVE ACCESSORIES, INC. has also marketed a series of hats (headware) each having a face scarf under the trademarks QUICK DRAW and QD. The face scarf has ends or tails that extend into and are stitched to the interior of the hat at an appropriate seam or other location inside the crown portion of the hat. The face scarf extends down over the ears and across the front portion of the face and over the neck area under the chin.

FIGS. 1 through 5 appended hereto show a sample prior art QUICK DRAW® product of SEIRUS INNOVATIVE ACCESSORIES, INC. A hat A has a face scarf B attached. The face scarf B has ends C and D each stitched or sewn to the interior surface E of the hat A. The face scarf B has an upper edge F that extends downward from inside the hat A and over the cheek area and the nose of a user. A lower edge G also extends downward from inside the hat A proximate the ears and down under the jaw of the user to a position below the chin of the user.

Articles of clothing such as the QUICK DRAW® product do not provide the user with total protection in the neck area from the elements even if a coat collar is brought upward to extend over the bottom edge H of the hat. The wind and other elements can penetrate absent other measures to protect. An item of apparel for the head that protects the face, the neck around the entire head, and the head itself comfortably and yet has the option to be placed in a stored configuration so that it can be reoriented between at least two configurations is not known.

BRIEF SUMMARY OF THE INVENTION

An item of headware or article of clothing for positioning on the head has a hat member for positioning upon the head of a user. The hat member has a lower rim sized to extend about the head of the user above the eyes of the user and proximate the back of the head of the user. The hat member also has a crown portion extending upward from the rim and sized to extend over the top of the head of the user.

A scarf member formed of a protective material is attached to the hat member and is configured for positioning about the face and neck of a user. The scarf member is formed to have an upper edge having a perimeter. The scarf member is connected to the lower rim about its perimeter which extends rearward from a first point on one side of the head of the user rearward about the head to a second point on the other side of the head of the user. The scarf member also has an eye edge extending from proximate the first point forward to and along the eye socket area of one eye, over the nose of the user and along the eye socket area of the other eye to proximate the second point. The scarf member has a lower edge extending about the neck of a user and spaced downward from the upper edge.

Preferably the crown of the hat member is sized to receive said face and scarf member with the hat member deployed on the user's head or being worn on the head by the user. In turn the scarf member is moveable from a first position in which the face and scarf member is deployed for positioning about the face and neck of the user and a second position in which said face and scarf member is positioned within the crown. Also preferably, the lower edge extends from the lower nape of the neck about the neck on both sides of the head to a point under the chin forward of the neck and proximate the chest.

The upper edge of the scarf member preferably includes a scarf scoop formed therein proximate the back of the head. The scarf scoop has a width from about one fourth of the back of the user's head to about three fourths of the width of the back of the user's head and a height of at least one half the width. The scoop has a scarf edge that is arcuate with a left edge and a right edge that extend upwardly toward the upper edge. The scarf scoop extends from about one fourth to about three fourths of the width of the back of the user's head. The scarf scoop has a height of about at least one half the width.

Preferably the lower rim has a hat scoop proximate the scarf scoop. The hat scoop is arcuate in shape defining a left edge and a right edge which extends downwardly toward the rim. The hat scoop is sized similar to the scarf scoop.

The left edge and a right edge of the scarf scoop and the left edge and said right edge of said hat scoop are positioned to be in substantial alignment. Size adjustment means such as an adjustable strap extends from the left edge of the hat scoop to the right edge of the hat scoop. The strap has a fastener operable to vary the width of the hat scoop and in turn the width of the scarf scoop.

In an alternate and preferred arrangement, the hat rim extends over the upper forehead and about the back of the head above the nape of the neck. A brim is affixed to the rim to extend outward from the forehead of the user.

In most preferred arrangements, the scarf member and the hat member are formed from fleece-like material.

DETAILED DESCRIPTION OF THE INVENTION

A hat 10 and scarf 12 combined into an item of headware is shown installed on a user in FIGS. 6-12.

Figure 1:
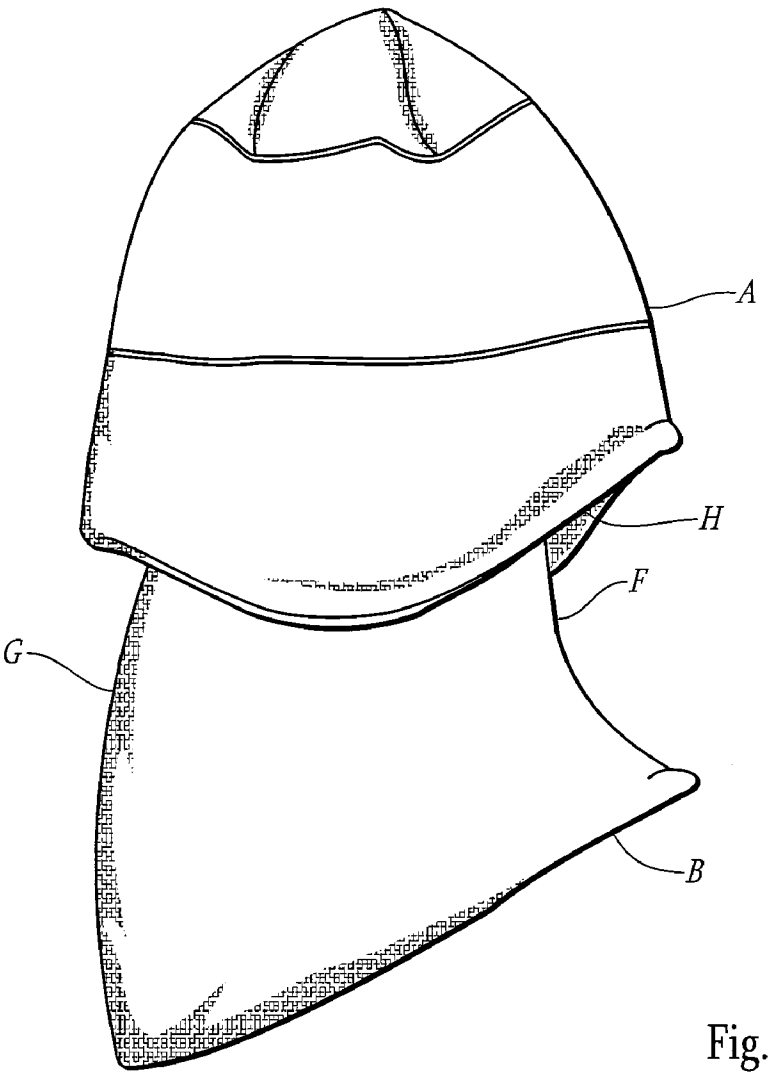
Fig. 1 (Prior Art)
FIG. 1 is one side view of headware of the prior art having a hat with a face and scarf member.
Figure 2:
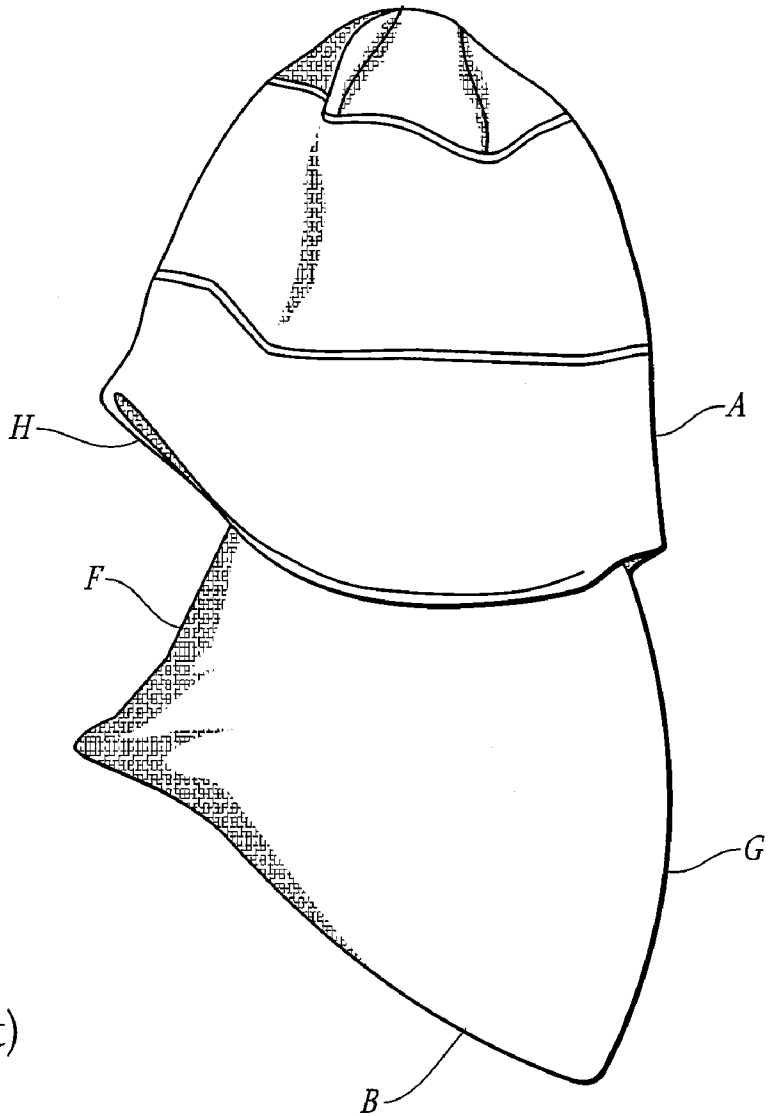
Fig. 2 (Prior Art)
FIG. 2 is another side view of headware of the prior art essentially opposite the side view of FIG. 1.
Figure 3:
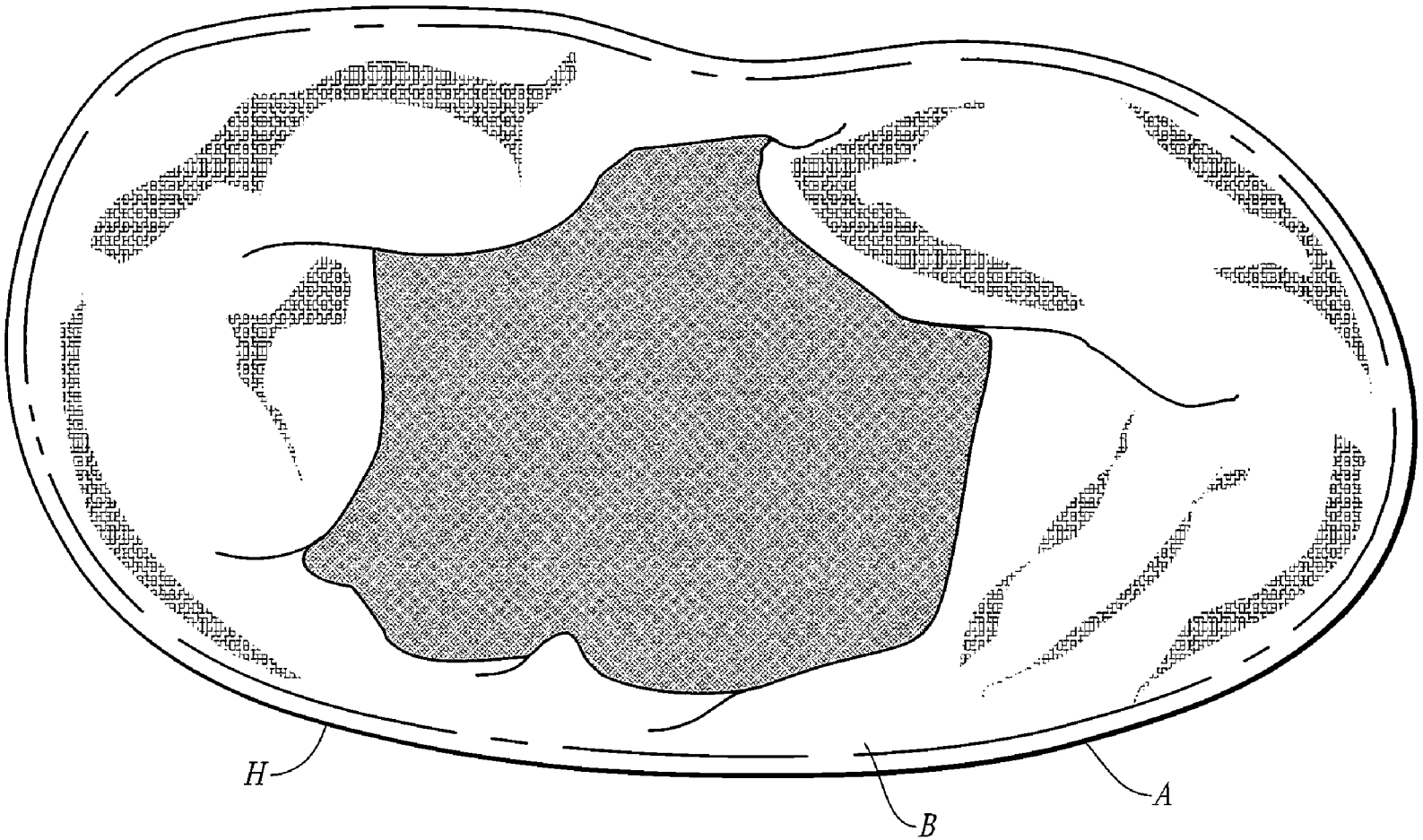
Fig. 3 (Prior Art)
FIG. 3 is a bottom view of headware of the prior art having a hat with a face and scarf member with the scarf member positioned in the inside of the hat.
Figure 4:
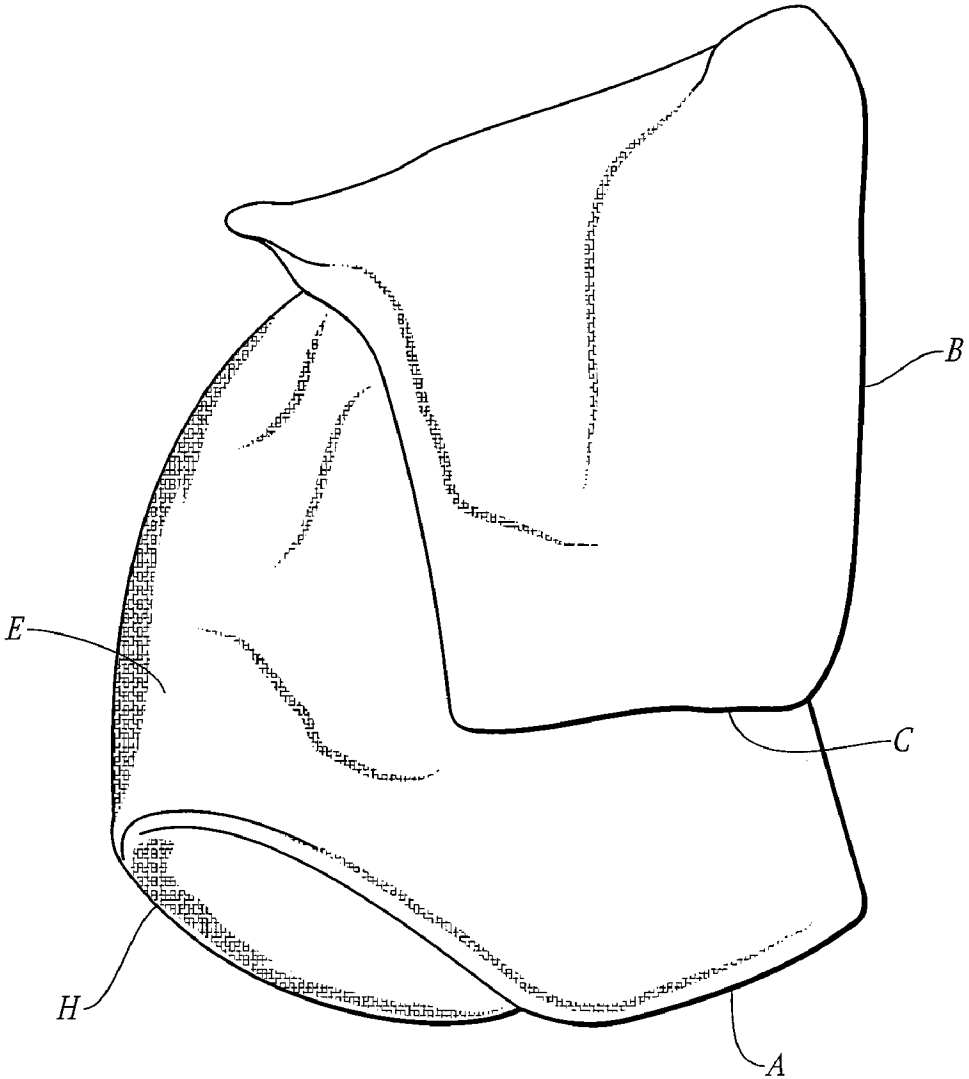
Fig. 4 (Prior Art)
FIG. 4 is a side view of headware of the prior art having a hat with a face and scarf member with the hat inside out.
Figure 5:
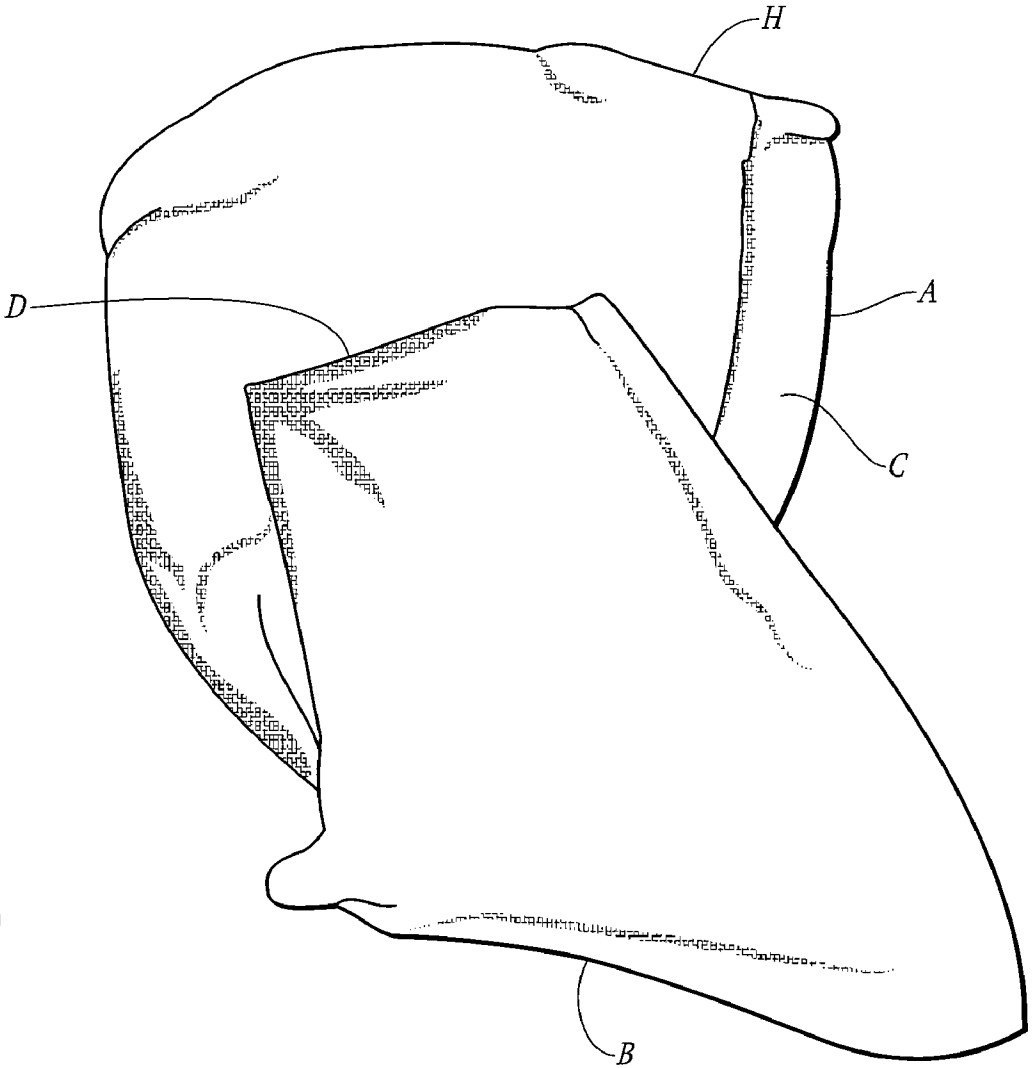
Fig. 5 (Prior Art)
FIG. 5 is another side view of headware of the prior art inside out and essentially opposite the side view of FIG. 4.
Figure 6:
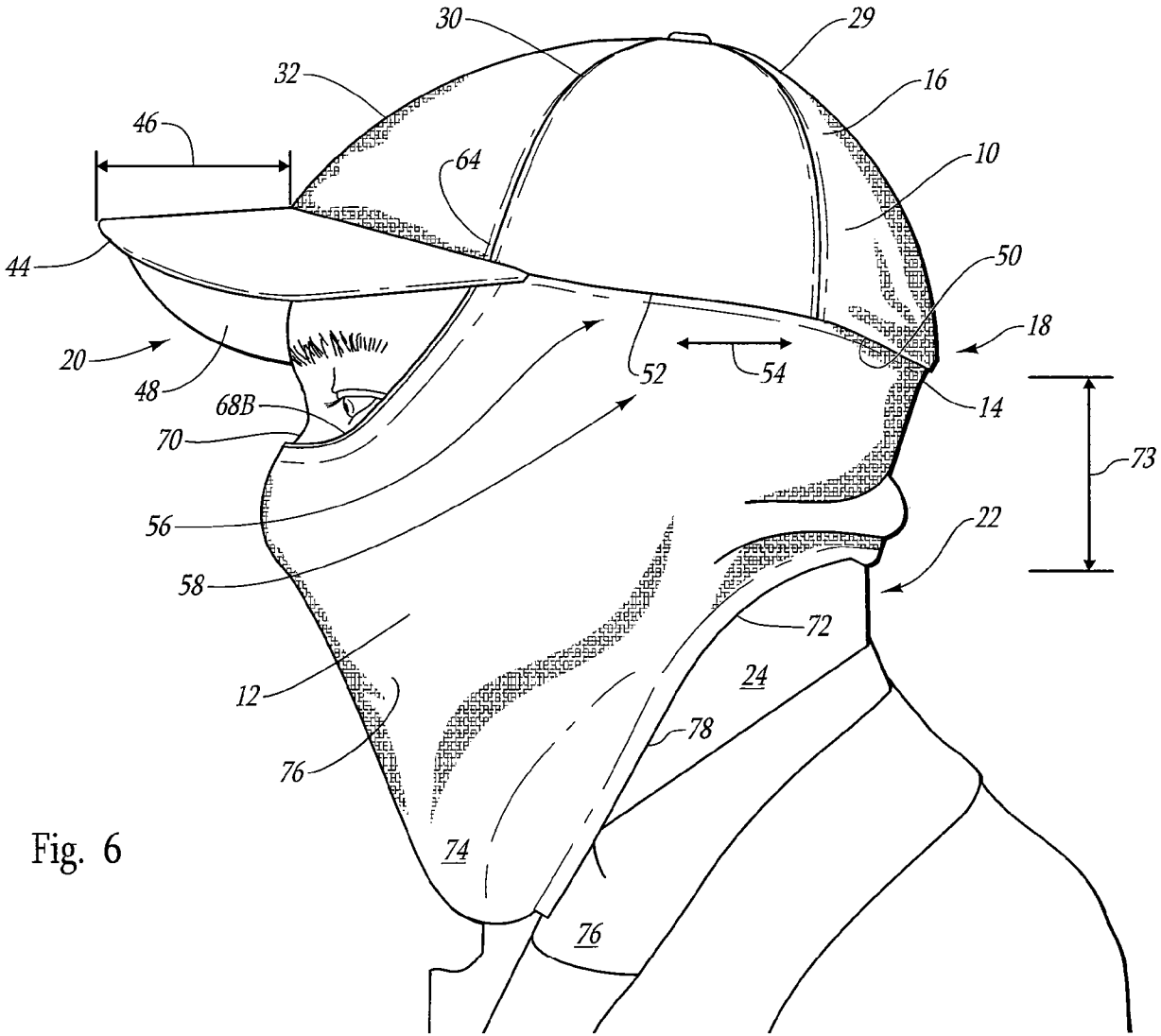
FIG. 6 is a left side view of headware of the present invention being worn by a user.

The hat 10 here shown has a rim 14 that extends about the head 11 of a user with a crown 16 extending upward from the rim 14 to enclose the head 11 of the user. The rim 14 is here shown to be essentially straight (in projection) in the planar side view of FIG. 6. Of course, the rim 14 is actually rounded or arcuate to fit along the side of or about the head as shown in FIG. 6.

As depicted, the rim 14 extends about the head 11 of the user from and about the middle 18 of the back of the head 11. The middle 18 of the back 19 of the head 11 may also be the lower edge of the base of the skull at the back 19 of the head 11. The rim 14 extends over the forehead area 20 of the user. The rim 14 may be positioned to be as far down the back of the head to be near the nape 22 of the neck 24 and extend around the head 11 over or about the area of the eyebrows 26 of the user. The actual positioning of the rim 14 will vary with the style of the hat 10 and the preferences of the user.

The crown 16 of the hat 10 is here shown to be generally hemispherical when worn and formed to enclose the head of the user above the rim 14. While the crown 16 is shown to be comparable to that of a baseball cap, the crown 16 may be in any suitable shape or size so long as it is big enough to retain the scarf 12 in its stored position and still fit comfortably on the head 11 of the user as hereinafter discussed. While a baseball hat has a generally hemispherical crown, other hats may be formed to be in some other shape when not worn but are deformable to fit on the head. A knitted cap or hat is but one example. Thus, one may find hats in a wide variety of shapes suitable or adaptable to use with a scarf 12 as herein disclosed.

Figure 12:
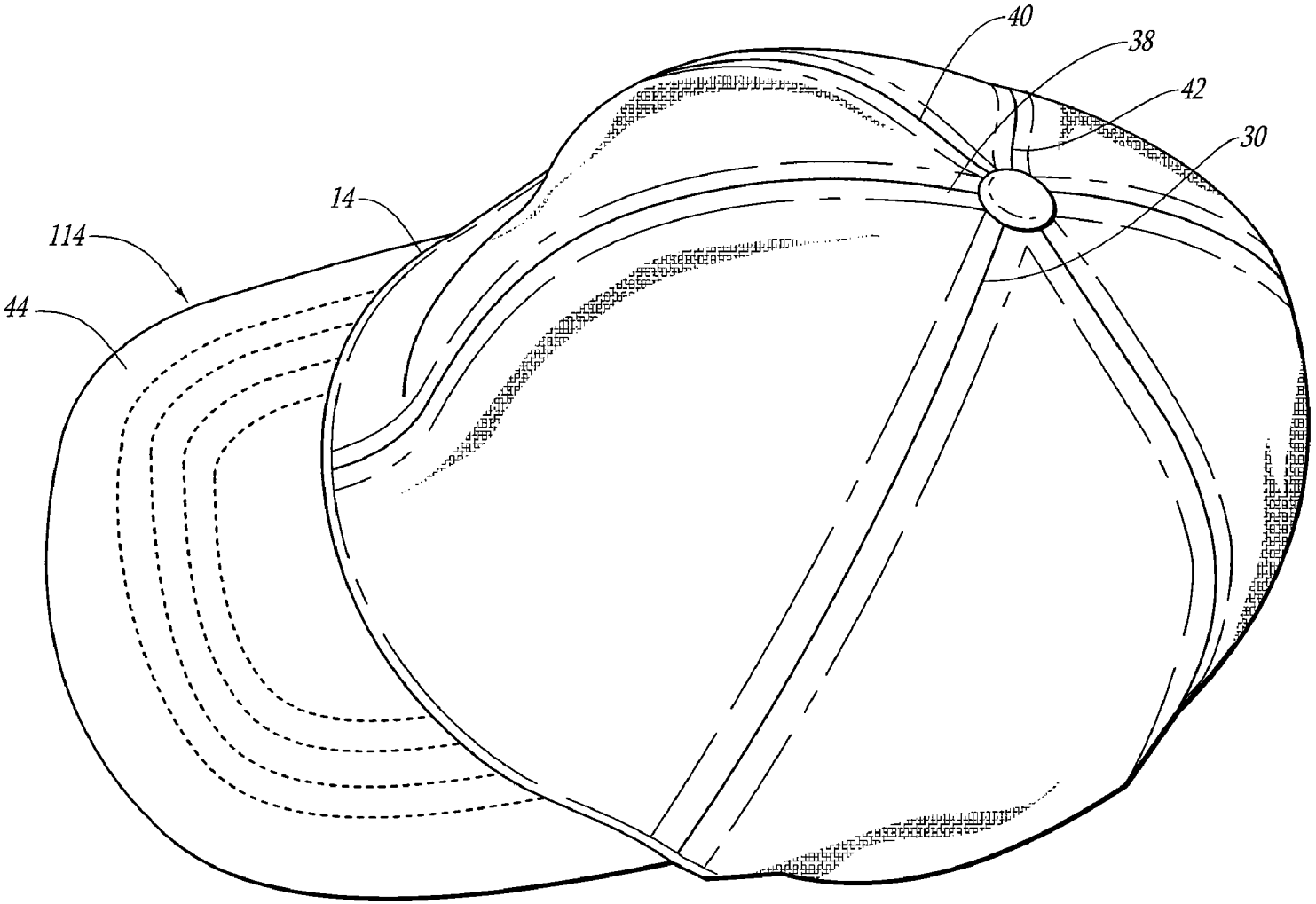

As here shown, the crown 16 is formed to have a plurality of rib seams 28, 30, 32, 34, 36 and 38 that all extend upward from the rim 14 to the top 40 of the crown and button 42 (see FIG. 12). A brim or bill 44 is connected to the hat 10 at the rim 14 by conventional means and extends away therefrom a distance 46 selected so that the bill 44 acts as a shade. The underside 48 of the bill 44 may be a dark color to facilitate light absorption for use in glaring sunlight.

Figure 9:
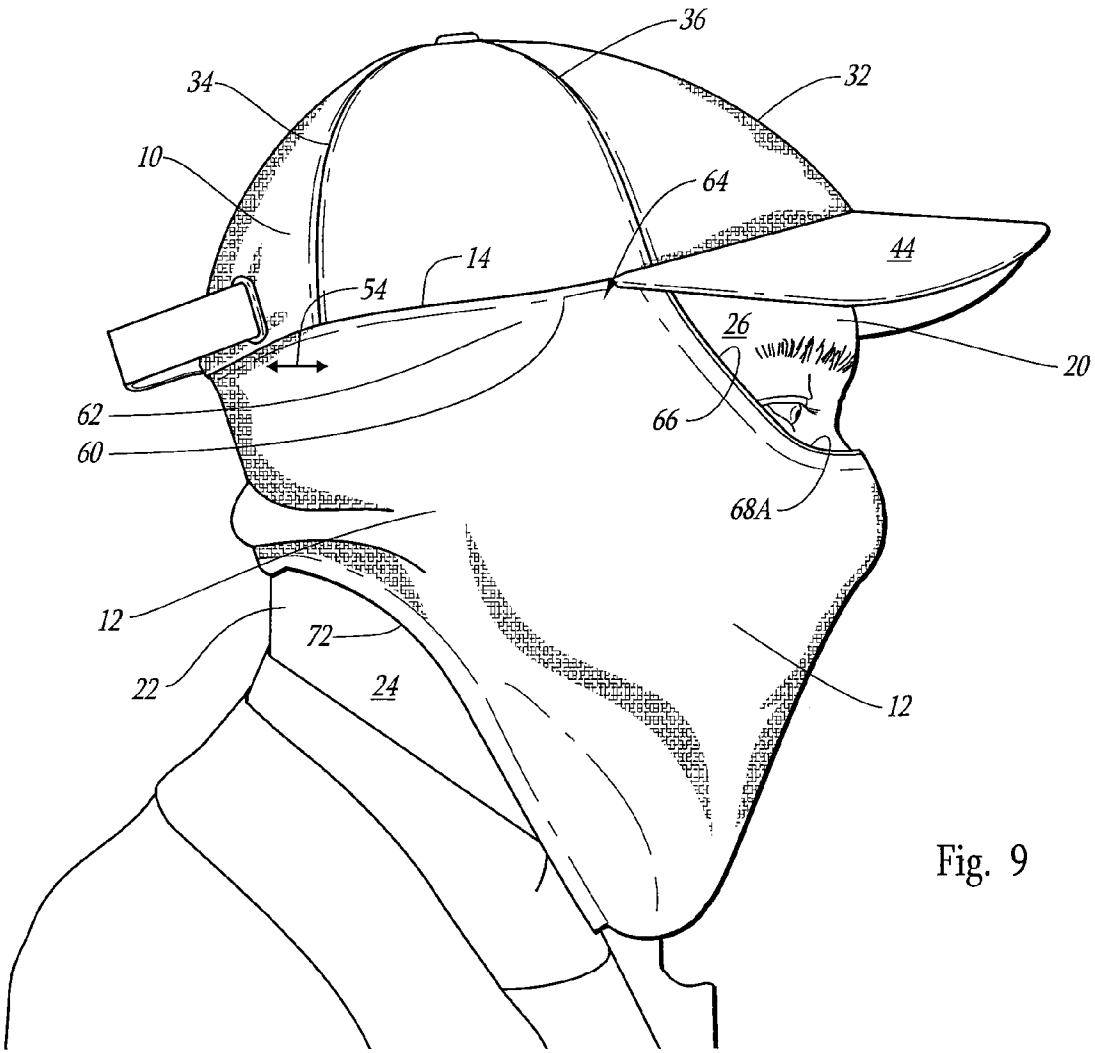
FIG. 9 is a right side view of the headware of FIGS. 6 and 7.

The scarf 12 has an upper edge 50 that has a perimeter 52 which extends 54 about, and is attached to, the rim 14 of the hat 10 to extend from about first point 56 of one side 58 of the head 11 of the user to a second point 60 on the other side 62 of the head 11 of the user. As here shown, the first point 56 is in the high temple area 64B and the second point 60 is in the high temple area 64A as best seen in FIGS. 6 and 9. The scarf 12 is sewn to the rim 14 about the perimeter 52 to form a weather resistant seal.

The scarf 12 also has an eye edge 66 that extends from proximate the first point 56 to an area proximate the second point 60. The eye edge 66 extends downward toward the cheeks and then over and along the left eye socket area 68B, over the nose 70 and preferably over the bridge of the nose, and then along the right eye socket area 68A as shown. The eye edge 66 is typically positioned so that the lower edge of sport goggles such as ski goggles are positioned thereon to form a weather resistant seal therewith.

A lower edge 72 of the scarf 12 is spaced from the upper edge 50 a distance 73 so that the scarf 12, when installed, covers from the back of the head 18 downward to the nape 22 of the neck 18. Thus, the collar of a ski jacket or other outer garment will easily effect a better seal at the back of the head for excluding or insulating the user from the elements. The lower edge 72 extends along the collar line or neck line toward an area 74 under the chin 76 of the user. Thus, the scarf 12 substantially covers the neck on the sides of the head. The scarf 12 extends to the area 74 under the chin 72 and covers the face and throat area. The lower edge is below the chin 72 and in the area of the juncture of the neck with the torso or chest. The scarf 12 is formed with sufficient material to have some folds 73 so that a coat or other garment can be brought up and secured about the neck to effect a seal to exclude snow, rain and the like.

The scarf 12 is here shown to have piping 78 (FIG. 6) attached to the scarf 12 at and along the lower edge 72 as well as the eye edge 66. The scarf 12 and the hat 10 are both formed of an elastically deformable fleece material.

Figure 11:
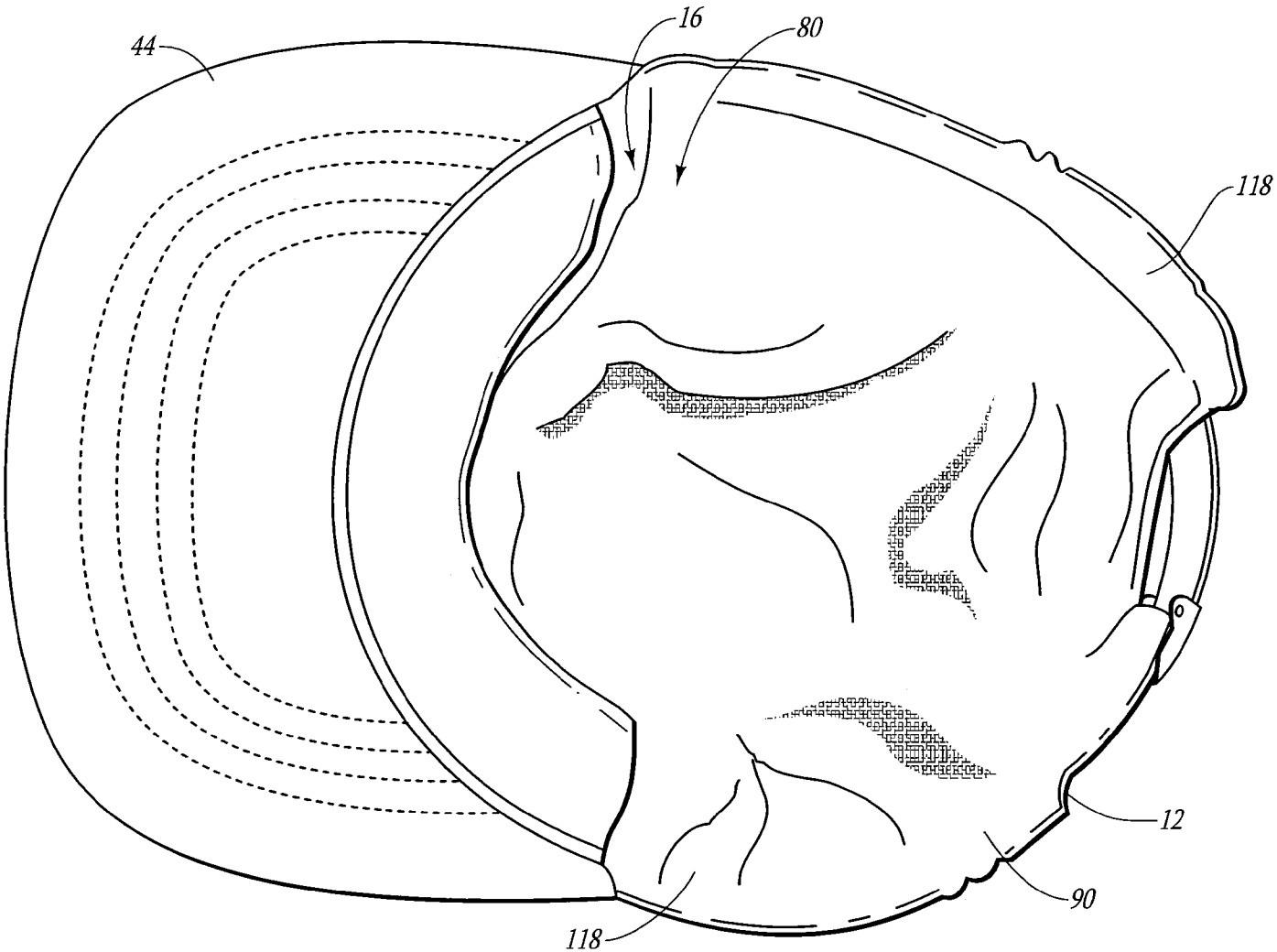
FIG. 11 is a bottom of the hat and scarf of FIGS. 6 and 7 positioned on a surface with the scarf member positioned in the crown of the hat member; and, FIG. 12 is a frontal perspective view of the hat and scarf of FIG. 16.

The scarf 12 can be seen in FIG. 6, for example, in a deployed position. In FIG. 11 we see the bottom side 80 of the hat 10 and the inside 81 of the crown 16 with the scarf 12 positioned in the crown 16 in the stored position 90 over hat band 114. Clearly, the scarf 12 can be moved from the stored position (FIG. 11) to the deployed position (FIG. 6) so that it may be worn as seen in FIG. 6.

Figure 7:
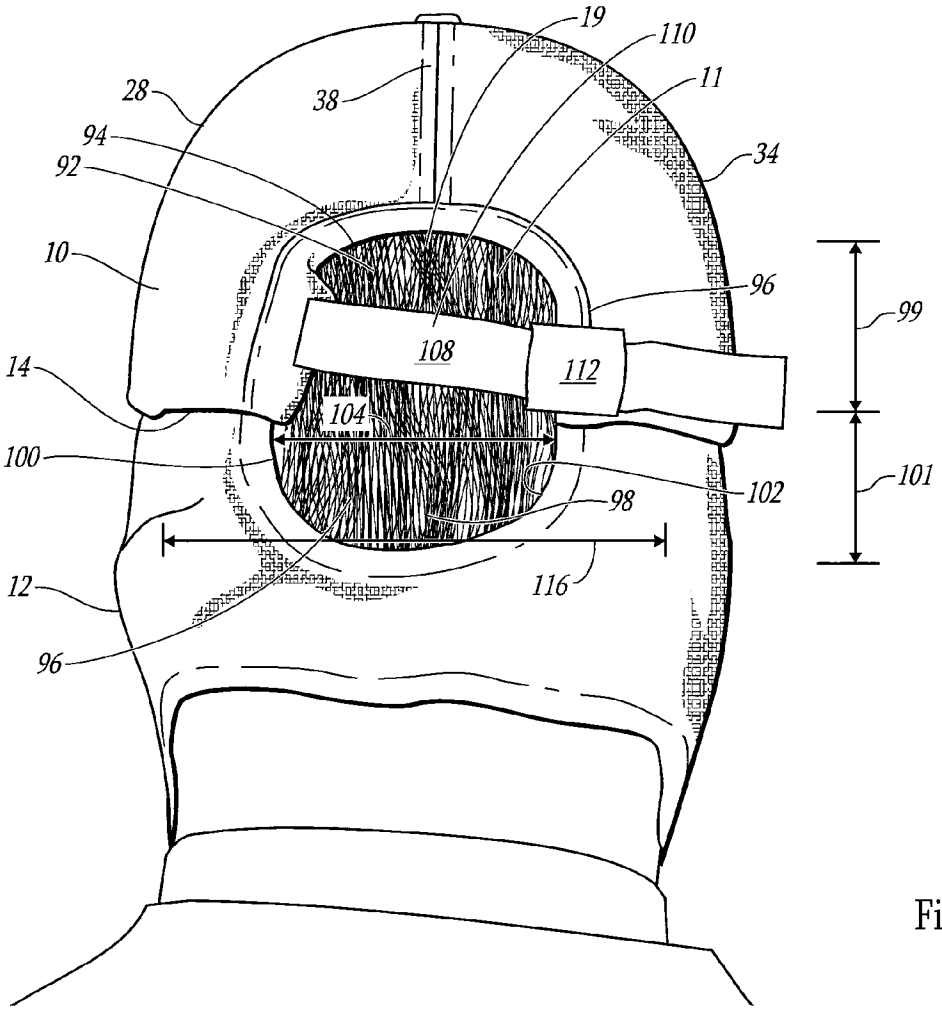
FIG. 7 is a rear view of the headware of FIG. 6.
Figure 8:
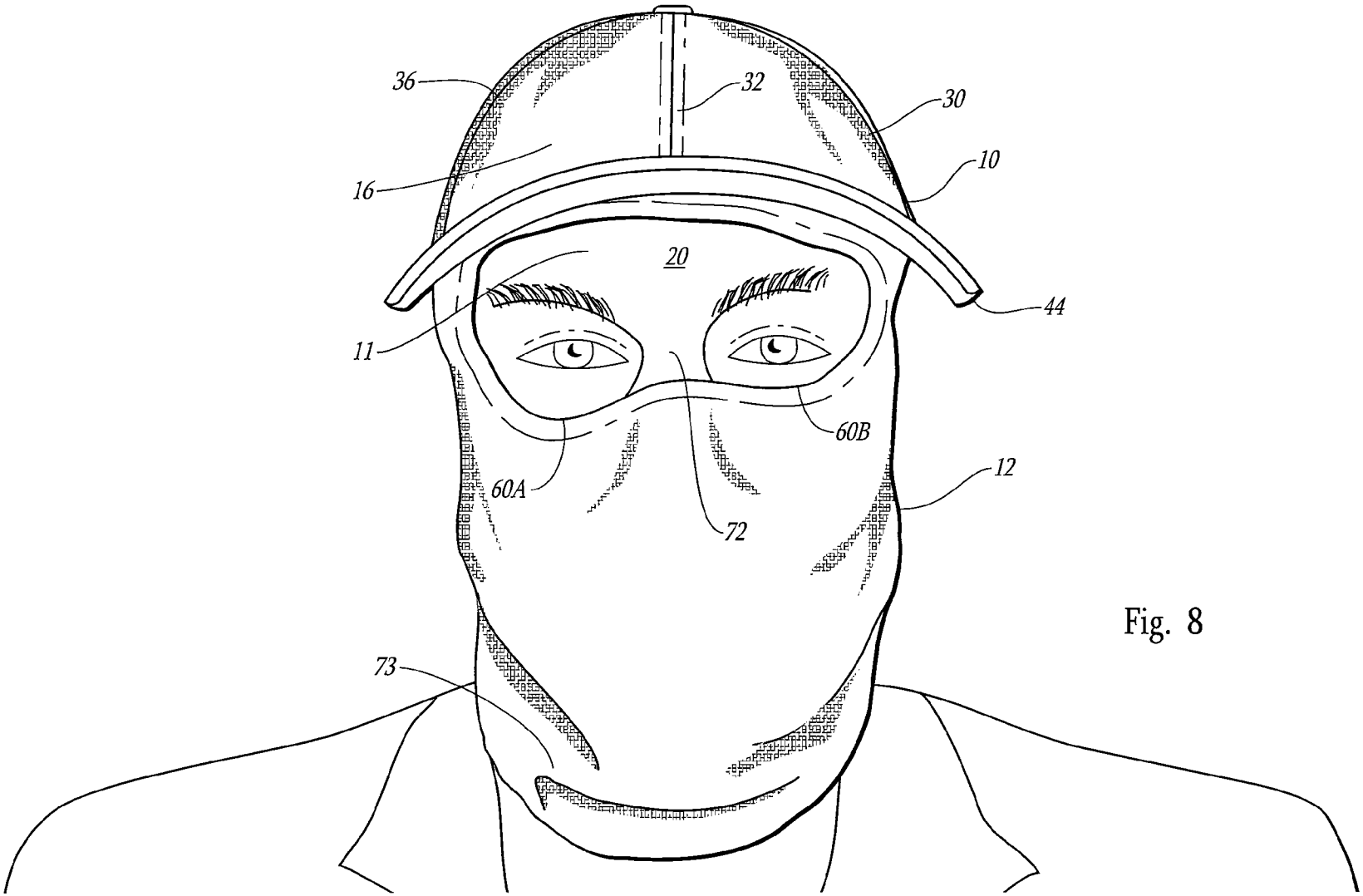
FIG. 8 is a front view of the headware of FIGS. 6 and 7.

In FIG. 7, it can be seen that the hat 10 has a scoop 92 formed to facilitate changing the size of the hat 10. The scoop 92 may come in a wide variety of shapes and sizes. As here shown, it is arcuate or semicircular with a left side 94 and a right side 96. The two sides 94 and 96 are not straight but rather generally extend downward toward the rim 16. The scarf 12 has a scarf scoop 98 similar to the hat scoop 92.

The scarf scoop 98 has a left side 100 and a right side 102 and is also shown to be semicircular in shape. Both the hat scoop 92 and the scarf scoop 98 are in general alignment with the left side 100 of the scarf scoop 98 extending into left side 94 of the hat scoop 92, and with right side 102 of the scarf scoop 98 extending into the right side 96 of the hat scoop. It can be seen that the scoops 92 and 98 have a width 104 that is from about one fourth the width 106 of the back 19 of the head 11 to about three fourths the width of the back 19 of the head 11. The scoops 92 and 98 both have a height 99 and 101 respectively, that is about at least one fourth their respective widths 104.

Size adjustment means 108 provides means for adjustability to accommodate users of different head size. The scoops 92 and 98 allow for the hat 10 and the scarf 12 to change their head dimensions from large to small by allowing the left side 94 and the right side 96 of the hat scoop 92 and the left side 100 and the right side 102 of the scarf scoop 98 to move toward and away form each other when adjusting the size. The size adjustment means 108 is here shown to be a strap 110 with a buckle 112. The strap 110 extends through the buckle which is operable to frictionally engage the strap 110. Other suitable means may be use to change the size as desired. For example, plastic extensions with small pins positioned to frictionally engage a plurality of apertures one for each size adjustment is known.

In use, it can be seen that the scarf 12 extends around the lower part of the head 11 and into the area of the nape 22 of the neck. The scarf 12 then fully covers from the rim down to below the collar line so that user is able to protect against rain, snow, sleet, and the like.

Figure 10:
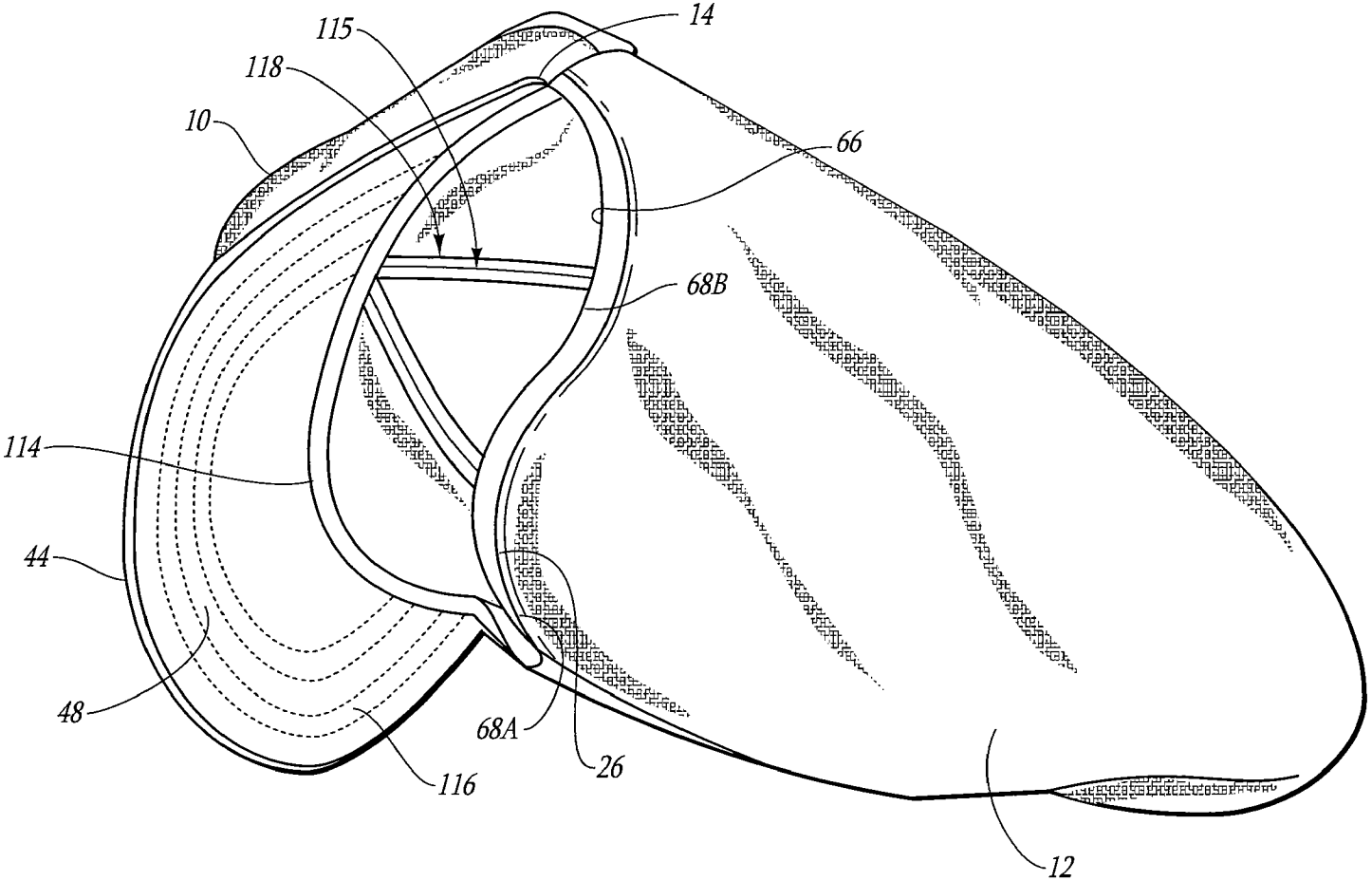
FIG. 10 is a frontal perspective view of the headware of FIGS. 6 and 7 positioned on a surface.

FIG. 10 shows the hat 10 and scarf 12 on a table. The eye opening 114 is shown defined by the eye edge 66 on the bottom and the rim 14 of the hat 10 on the top. Extending away and interior to the crown is a hat band 114 which is an elastic like material to accommodate different head shapes. A sweat band could also be used. The interior 118 of the crown 16 can also be seen. The underside 48 of the brim 44 is shown to be of a dark material. Such is preferred to reduce the glare that can be experienced from reflections from snow, ice or other reflective surfaces.

FIG. 11 shows the interior 118 of the crown 16 with the scarf 12 folded and positioned in the stored position 90. Thus, the scarf 12 material is preferably pliable and foldable. Fleece has been found to be most suitable. However other materials may also be used so long as the scarf 12 can be folded or collapsed and positioned in the crown 16.

What is claimed is:

1. Headware comprising:

a hat member for positioning upon the head of a user, said hat member including:

a lower rim sized to extend about the head of a user, and a crown portion extending upward from said lower rim and sized to extend over the top of the head of the user, said crown being sized to receive a scarf member when said hat member is being worn by the user; and the scarf member formed of a weather protective material and sized for positioning about the face and neck of a user, said scarf member being fixedly attached to said hat member and being moveable from a first position in which said scarf member is deployed for positioning about the face and neck of the user and a second position in which said scarf member is positioned within said crown, said scarf member including:

an upper edge including a perimeter fixedly attached to said lower rim, said upper perimeter extending from proximate a first point on one side of the head of the user rearward about the head to proximate a second point on the other side of the head of the user, an eye edge extending from proximate said first point to over the nose of the user to proximate said second point to define an eye opening, and a lower edge encircling the neck of the user.

2. The headware of claim 1, wherein said lower edge extends from the nape of the neck about the neck on both sides of the head and proximate the juncture of the neck and the torso.

3. The headware of claim 2, wherein said upper edge of said scarf member further comprises a scarf scoop formed therein proximate the back of said user's head, said scarf scoop having a scarf edge that is arcuate with a scarf scoop left side and a scarf scoop right side that extend upwardly toward said upper edge.

4. The headware of claim 1, wherein said lower rim extends about the forehead and about the back of the head above the nape of the neck.

5. The headware of claim 4, wherein the hat member has a brim affixed to said lower rim to extend outward from the forehead of the user.

6. The headware of claim 1, wherein hat member and said scarf member are formed of an elastically deformable material.

7. The headware of claim 6, wherein at least one of said hat member and said scarf member is formed from fleece-type material.

8. Headware suitable for use in cold weather comprising:

a scarf member sized for positioning about the face and neck of a user, said scarf member including:

an upper edge having including a perimeter extending from proximate a first point on one side of the head of the user rearward about the head to proximate a second point on the other side of the head of the user, an eye edge extending from proximate said first point to over the nose of the user to proximate said second point, and a lower edge extending about the neck of the user, said lower edge being spaced downward from said upper edge and downward from said eye edge to below the chin, said lower edge extending from the nape of the neck about the neck on both sides of the head, and a hat member for positioning upon the head of a user, said hat member including:

a lower rim sized to extend about the head of a user with said scarf permanently attached thereto, and a crown portion extending upward from said lower rim and sized to extend over the top of the head of the user, said crown being sized to receive said scarf member when said hat member is being worn by a user and said scarf member being moveable from a first position in which said scarf member is deployed for positioning about the face and neck of the user and a second position in which said scarf member is positioned within said crown.

9. The headware of claim 8 wherein at least one of said hat member and said scarf member is formed of a fleece-type material.

10. The headware of claim 8, wherein said upper edge of said scarf member further comprises a scarf scoop formed therein proximate the back of said user's head, said scarf scoop having a scarf edge that is arcuate with a scarf scoop left side and a scarf scoop right side that extend upwardly toward said upper edge.

11. The headware of claim 10, wherein said lower rim has a hat scoop proximate said scarf scoop, said hat scoop is arcuate in shape and includes a hat scoop left side and a hat scoop right side that generally extend downward to said lower rim.

12. The headware of claim 11, wherein said hat scoop and said scarf scoop are sized to extend from about one fourth to about three fourths of the width of the back of said user's head.

13. The headware of claim 12, wherein said scarf scoop left side is in general alignment with said hat scoop left side and said scarf scoop right side is in general alignment with said hat scoop right side.

14. The headware of claim 13, wherein said hat scoop includes size adjustment means that extend between said sides of said hat scoop.

15. An article of clothing suitable for use in cold weather, comprising:

a hat member for positioning upon the head of a user, said hat member including:

a lower rim sized to extend about the head of user above the eyes of the user and about the back of the neck of the user, a crown portion extending upward from said rim and sized to enclose the top of the head of the user; said crown portion being formed of protective material;

a scarf member formed of a protective material for positioning about the neck of a user and draping along the face of the user, said scarf member being sized to fit in said crown of said hat member when said hat is being worn by a user, said scarf member being moveable from a first position in which said scarf member is deployed for positioning in front of the face and about the neck of the user and a second position in which said scarf member is positioned within said crown, said scarf member including:

an upper edge including a perimeter, said upper edge being stitched to said lower rim about said perimeter from a first point on one side of the head of user rearward about the head to a second point on the other side of the head of the user, an eye edge extending from proximate said first point to over the nose of the user to proximate the said second point to define an eye opening, and a lower edge encircling about the neck of a user;

wherein the hat member has an adjustable size such that the crown portion fits on the head of a user when the scarf member is in the second position within said crown.

16. The article of clothing of claim 15 wherein said hat member includes adjustment means to adjust the size of the lower rim, wherein said hat member includes a brim connected to said lower rim to extend from the user's forehead area when said article of clothing is being worn, and wherein said scarf member is made of elastically deformable material.

17. The article of clothing of claim 15, wherein said upper edge of said scarf member further comprises a scarf scoop formed therein proximate the back of said user's head, said scarf scoop has having a scarf edge that is arcuate with a scarf scoop left side and a scarf scoop right side that extend upwardly toward said upper edge.

18. The article of clothing of claim 15, wherein said crown portion is formed of an elastically deformable material and the adjustable size of the hat member is provided at least in part by said elastically deformable material as said elastically deformable material deforms when said scarf is in said second position and said hat member is positioned upon the head of a user.

19. An article of clothing suitable for use in cold weather, comprising:

a hat member for positioning upon the head of a user, said hat member including:

a lower rim sized to extend about the head of user above the eyes of the user and about the back of the neck of the user, a crown portion extending upward from said rim and sized to enclose the top of the head of the user; said crown portion being formed of protective material;

a scarf member formed of a protective material for positioning about the neck of a user and draping along the face of the user, said scarf member being sized to fit in said crown of said hat member when said hat is being worn by a user, said scarf member being moveable from a first position in which said scarf member is deployed for positioning in front of the face and about the neck of the user and a second position in which said scarf member is positioned within said crown, said scarf member including:

an upper edge including a perimeter, said upper edge being connected to said lower rim about said perimeter from a first point on one side of the head of user rearward about the head to a second point on the other side of the head of the user, an eye edge extending from proximate said first point to over the nose of the user to proximate the said second point to define an eye opening, and a lower edge encircling about the neck of a user;

wherein the hat member has an adjustable size such that the crown portion fits on the head of a user when the scarf member is in the second position within said crown; and, wherein said hat member includes adjustment means to adjust the size of the lower rim, wherein said hat member includes a brim connected to said lower rim to extend from the user's forehead area when said article of clothing is being worn, and wherein said scarf member is made of elastically deformable material.

* * * * *